US005683045A

United States Patent [19]

Staniszewski

[11] Patent Number: 5,683,045

[45] Date of Patent: Nov. 4, 1997

[54] PAPER-TEARING ROLLERS ASSEMBLY

[75] Inventor: Tadeusz Staniszewski, Budd Lake, N.J.

[73] Assignee: Shap, Inc., Budd Lake, N.J.

[21] Appl. No.: 410,965

[22] Filed: Mar. 27, 1995

[51] Int. Cl.[6] ..... B02C 4/30

[52] U.S. Cl. ..... 241/236; 225/97; 241/260.1; 241/293

[58] Field of Search ..... 225/93, 97, 100, 225/103, 80, 106, 96; 241/236, 260.1, 293; 83/492, 495, 591, 430; 493/354, 395, 464

[56] References Cited

U.S. PATENT DOCUMENTS

| | | | |
|---|---|---|---|
| 93,668 | 8/1869 | Brasil et al. | 241/236 |
| 664,001 | 12/1900 | Nisbett et al. | 83/345 |
| 1,825,223 | 9/1931 | Deck | 83/430 |
| 1,939,246 | 12/1933 | Antonsen | 225/97 |
| 2,815,077 | 12/1957 | Pechy | 83/430 |
| 3,333,752 | 8/1967 | Vincens | 225/97 |
| 3,768,712 | 10/1973 | Imbert | 225/3 |
| 4,422,581 | 12/1983 | Chryst | 83/430 |
| 4,959,986 | 10/1990 | Kranis | 83/430 |
| 5,054,351 | 10/1991 | Jolliffe et al. | 83/430 |
| 5,152,206 | 10/1992 | Mulling | 83/430 |

FOREIGN PATENT DOCUMENTS

| | | | |
|---|---|---|---|
| 2225152 | 12/1973 | Germany | 83/495 |
| 761607 | 11/1956 | United Kingdom | 83/495 |

*Primary Examiner*—Kenneth E. Peterson
*Attorney, Agent, or Firm*—Bernard J. Murphy

[57] ABSTRACT

Paired, coacting, albeit non-contacting rollers have interfitting collars or rings, and tapered rims, which are rotatably driven in opposite directions. Paper fed therebetween is torn asunder, and freely discharged therefrom. The rings cooperate together to force the paper to be torn lengthwise thereof, and the rims crease the resulting strips to insure that they do not remain lodged between the rings. An embodiment has helical rings or collars which cause the paper to be dismembered into diagonally-shaped, fine fragments.

6 Claims, 4 Drawing Sheets

PAPER-TEARING ROLLERS ASSEMBLY

This invention pertains to paper shredders, generally, and in particular to a novel rollers assembly for a paper shredder which tears the throughput paper into pieces rather than cutting of the same.

Paper-cutting shredders are well known in the prior art and they perform most efficiently. However, they are unduly expensive and require some precision machining and assembly. Too, over time, the cutting blades or wheels need to be sharpened and/or replaced.

What has been needed is a rollers assembly, for a paper shredder in which there is no need for razor-edge, cutting blades or wheels, and no requirement for precision machining and assembly of interengaging blades or wheels. Especially what has been long sought is a paper shredder, or a rollers assembly therefor, in which there will never arise amy need to replace any component for resharpening as no such sharp component is used in the device.

In view of the aforesaid needs, it is an object of this invention to set forth a rollers assembly, for a paper-tearing shredder, which has no cutting blades or wheels, in that it does not cut the throughput paper, rather, it tears the paper into pieces.

Particularly, it is an object of this invention to set forth a rollers assembly, for a paper-tearing shredder, comprising a pair of rollers, rotatable in opposite directions on parallel axes; wherein each of said rollers has raised collars formed thereon; said collars have flat-surfaced, circumferential peripheries; and said collars of one of said rollers are non-contactingly interdigitated with said collars of the other of said rollers. It is also an object of this invention to set forth a paper-tearing rollers assembly comprising a pair of elongate rollers, rotatable in opposite directions on parallel, central axes; wherein said rollers have means mutually cooperative for tearing sheet paper into strips; and means carried by said rollers for forming said paper strips into V-shaped, channel configurations.

Further objects of this invention, as well as the novel features thereof, will become apparent by reference to the following description, taken in conjunction with the accompanying figures, in which.

Figure 1:
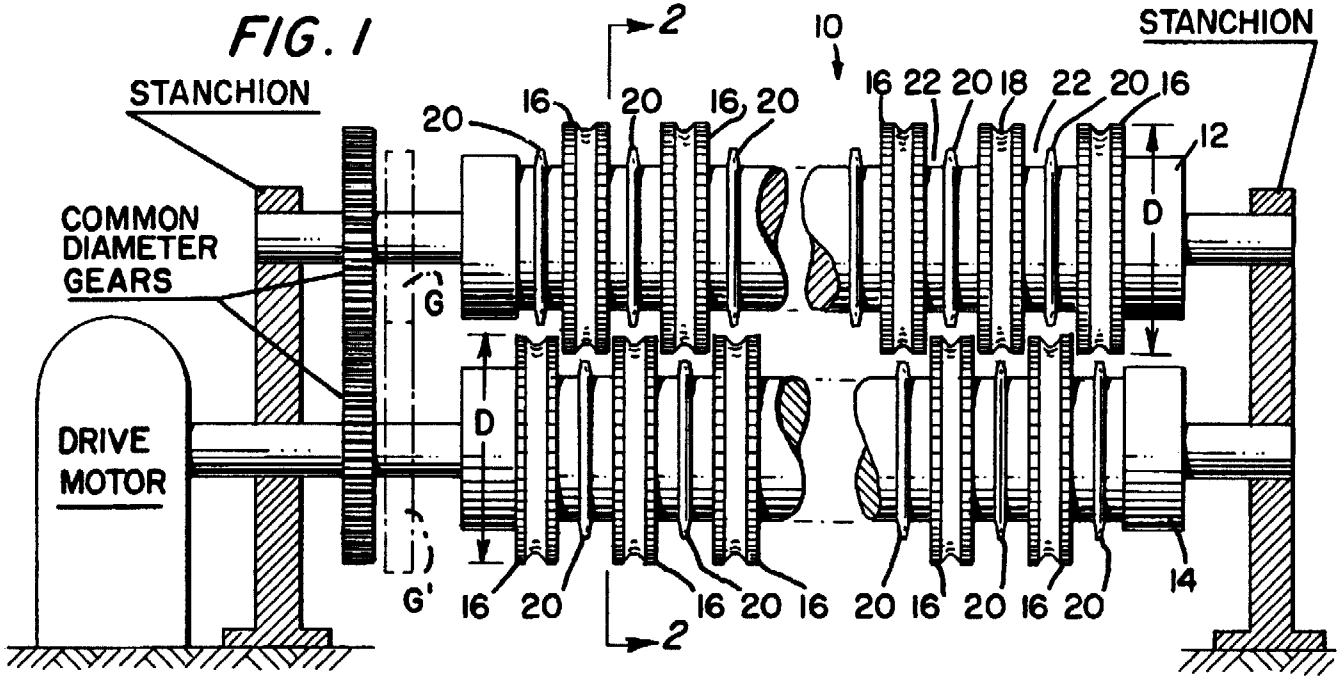
FIG. 1 is a discontinuous, front, elevational view of a rollers assembly, according to an embodiment of the invention.
Figure 5:
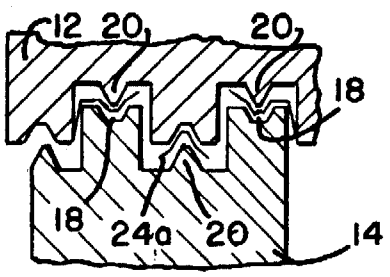
Figure 4:
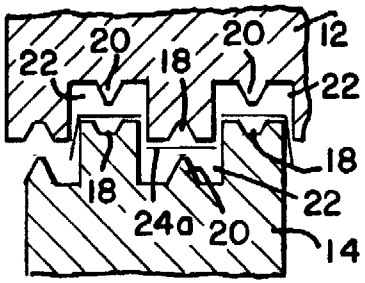
Figure 3:
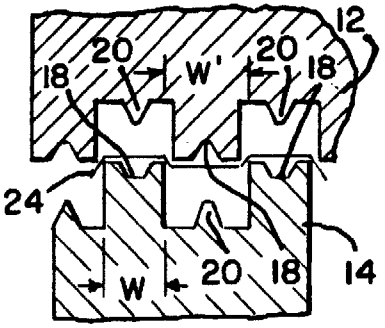
Figure 2:
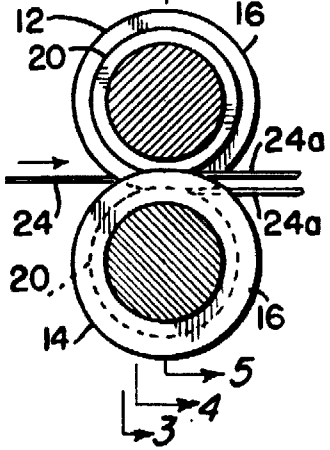
FIG. 2 is a cross-sectional view taken along section 2—2 of FIG. 1.
Figure 9:
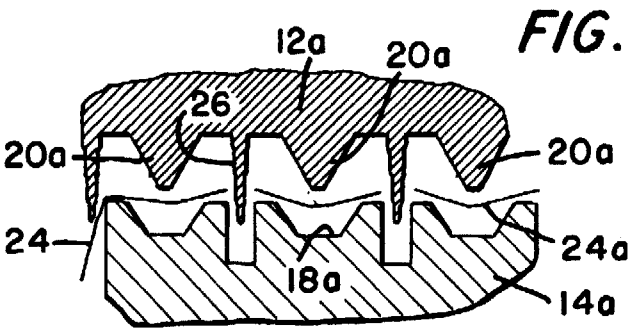
Figure 6:
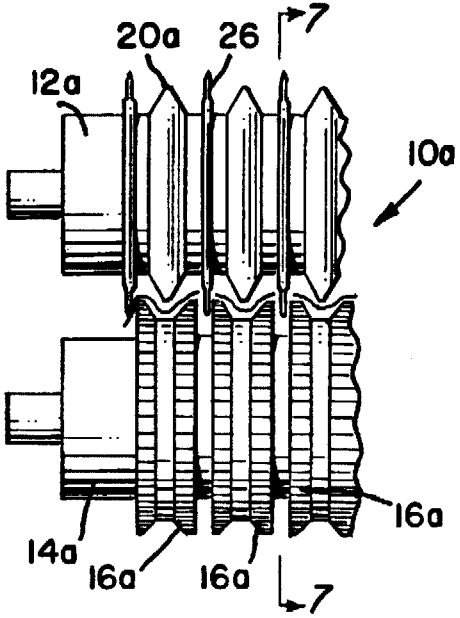
Figure 7:
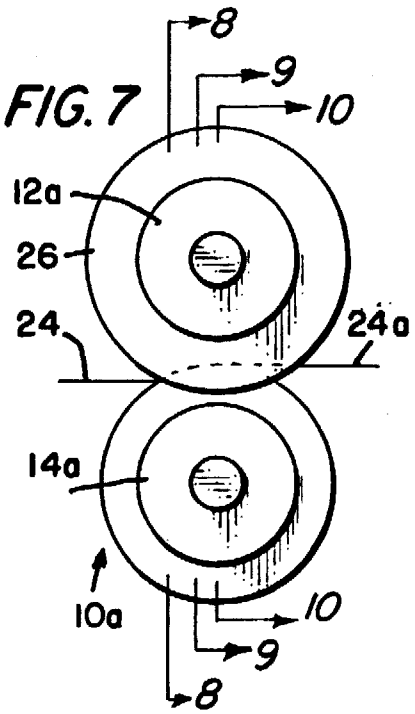
Figure 8:
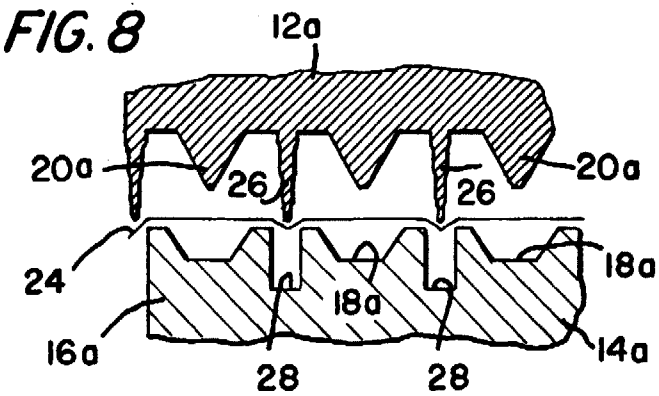
Figure 10:
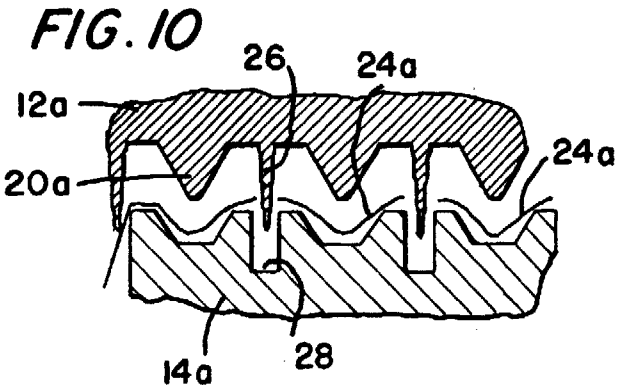
Figure 12:
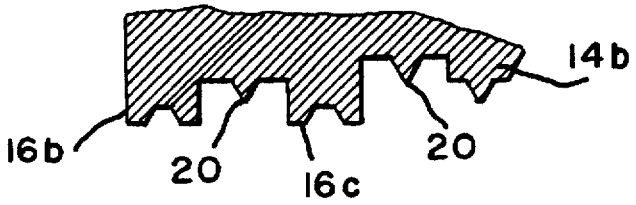
Figure 13:
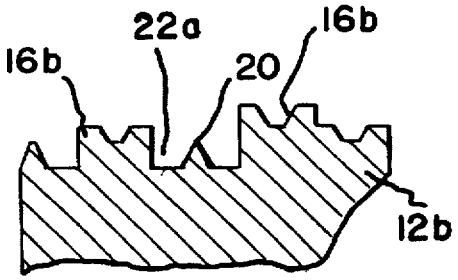
Figure 14:
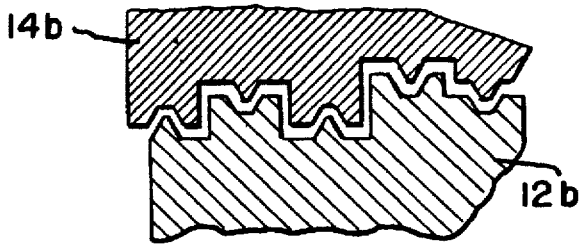
Figure 11:
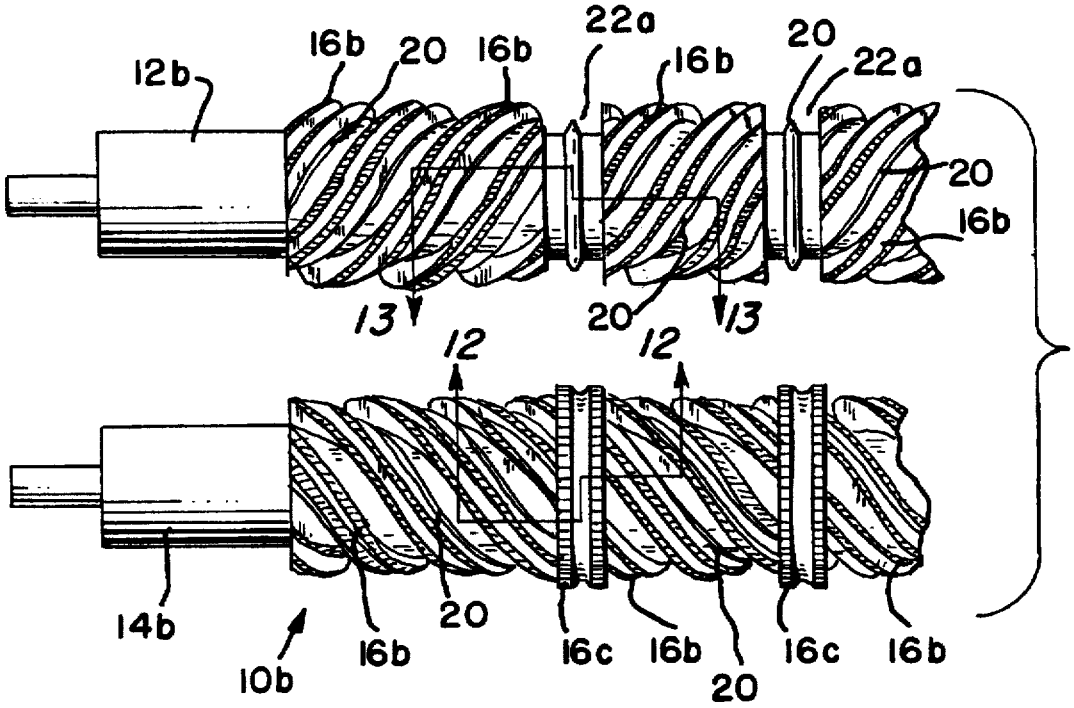
Figure 16:
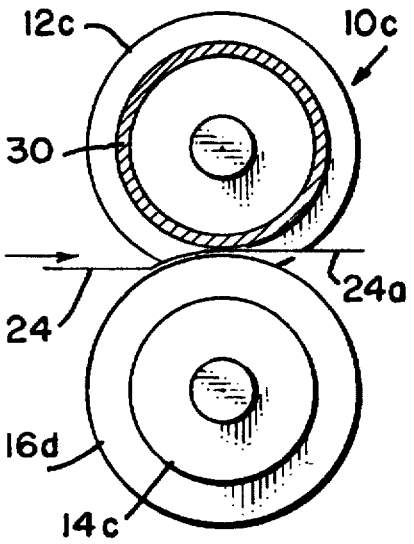
Figure 15:
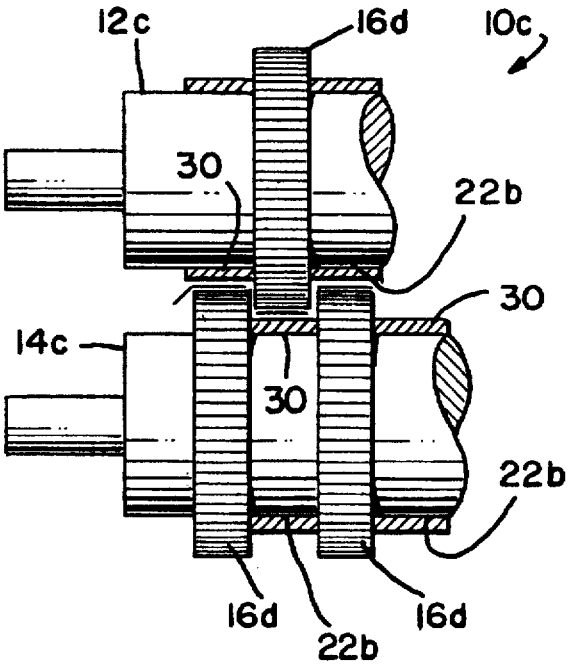
Figure 17:
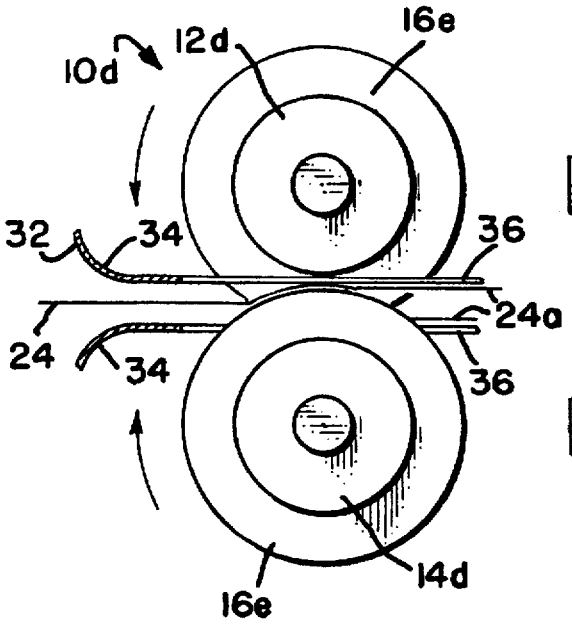
Figure 18:
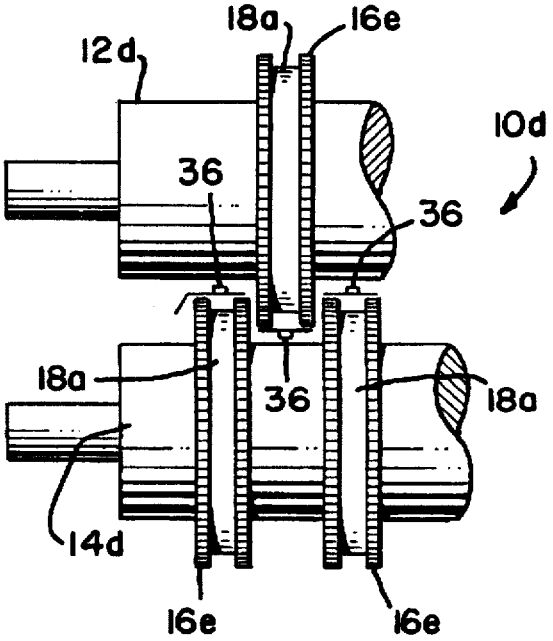

FIGS. 3, 4 and 5 are fragmentary, cross-sectional views, taken along sections 3—3, 4—4, and 5—5 of FIG. 2, but are considerably enlarged over the scale of FIG. 2;

FIG. 6 is a partial, front elevational view of a rollers assembly, according to an alternative embodiment of the invention;

FIG. 7 is a cross-sectional view taken along section 7—7 of FIG. 6;

FIGS. 8, 9 and 10 are fragmentary, cross-sectional views, taken along sections 8—8, 9—9, and 10—10 of FIG. 7;

FIG. 11 is an illustration similar to that of FIG. 1, albeit of yet another, alternative embodiment of the invention;

FIGS. 12 and 13 are cross-sectional, fragmentary views, taken along sections 12—12 and 13—13 of FIG. 11;

FIG. 14 depicts an operative engagement of the configurations of rollers in FIGS. 12 and 13;

FIG. 15 is a partial, elevational view, also partly cross-sectioned, of a further, alternative embodiment of the invention, showing coacting rollers;

FIG. 16 is an end view of the FIG. 15 illustration;

FIG. 17 illustrates an end view of the FIG. 18 embodiment of the invention, showing a paper guide and fingers; and FIG. 18 is a partial, elevational view of coacting rollers, and paper-strip-engaging fingers.

As shown in FIGS. 1 and 2, a rollers assembly 10, for a paper-tearing shredder, according to an embodiment of the invention, comprises a pair of rollers 12 and 14. The rollers 12 and 14 have raised collars 16 formed thereon and, in this embodiment, the collars 16 comprise fully circular rings. Each of the rings 16 has an annular groove 18 formed therein, and each ring 16 has juxtaposed therewith a rim 20 of tapered configuration. The rings 16 are spaced apart therewith a rim 20 of tapered configuration and blunt, outermost periphery. The rims 20 of one roller 12 are located within the gaps 22 of roller 12, and protrude therefrom into the grooves 18 of roller 14 and, likewise, the rims 20 of roller 14 are positioned within the gaps 22 of roller 14 and protrude therefrom into the grooves 18 of roller 12. The rims are in close proximity to the grooves 18. Cross-sections shown in FIGS. 3 through 5, taken from FIG. 2, show the progressive interdigitation of the rings 16, of rollers 12 and 14, and the subdivision of paper which enters the assembly 10. Each ring 16 has a width "W" and the intervening gaps 22 have a greater width "W'"; consequently, the rings 16 interdigitate, as noted, but non-contactingly.

Paper 24 which is fed into the rollers assembly 10 is torn apart, vertically, not cut, as the paper 24 is never addressed by any cutting blades or knives. The paper-engaging peripheries of the rings 16 are flat-surfaced. Lateral edges of the paper 24 is bent over the end of a outermost ring 16, as shown in FIG. 3, and this tends to keep the paper flat across the other rings 16. Now, as the paper 24 cannot stretch, it tears apart at the sides of the rings 16 which enter the gaps 22. To facilitate the feed through of the paper 24, the rings 16 have knurling formed on the flat-surfaced peripheries thereof.

As can be discerned in FIG. 4, the paper strips **24*a* which are formed by the tearing dismemberment of the paper have a width substantially equal to the width "W'" of the gaps 22. Without some provisioning for dislodging them the strips 24*a* would, due to the fibrous nature of the torn sides thereof, collect in the gaps 22. However, the instant invention has anticipated this matter, and provided means for obviating the problem. The rims 20, as can be discerned best in FIG. 5, close onto the grooves 18. As a consequence of this, the strips 24*a* are bent into channel-like elements; the fibrous sides thereof are removed from the sides of the rings 16, and they exit the rollers assembly 10 freely. Commonly, paper fed into a shredder tends to move laterally or in some skewed manner as the end of the paper sheet is about to exit the shredder. As the strips 24*a* are formed into the channel-like, V-shaped pieces, they hold the paper sheet against any excursive movement, laterally or otherwise, until the last thereof is torn apart into strips 24*a* for exiting from the assembly 10. As can be understood, the rings 16 on rollers 12 and 14, comprise means which are mutually cooperative for tearing the paper 24 into strips. Too, it is the rims 20, which are carried by the rollers 12 and 14, and which intrude into the grooves 18**, which form the paper strips into V-shaped channel configurations.

FIGS. 6 through 10 correspond, generally to FIGS. 1 through 5, albeit the former depict an alternative embodiment **10*a* of rollers assembly. In this embodiment, roller 14*a* has a similar series of rings or collars 16*a* with annular, circumferential grooves 18*a*. Roller 12*a* has similar rims 20*a* which enter the grooves 18*a*. In addition, in lieu of rings or collars, roller 12***a* has discs 26 which intrude into annular reliefs 28 which are formed between the collars 16*a*. Again, with a lateral edge of the paper 24 bent over the end of roller 14*a*, as shown in FIG. 8, the confined portion of the paper 24 is held flat across the collars or rings 16*a*. However with the meshing or inter-digiting of roller 12*a* with roller 14*a*, the discs 26 move into the reliefs 28 and tear the paper 24 asunder. With the progressive meshing of the rollers 12*a* and 14*a*, the rims 20, again, form the strips 24*a* into the channel-like, V-shaped lengths in order that the latter can freely exit the assembly 10*a*.

Another alternative embodiment 10*b* of the rollers assembly is shown in FIGS. 11 through 14. Here, the rollers 12*b* and 14*b* have the raised collars 16*b* in helical form. Roller 12*b* has annular reliefs 22*a* formed therein, the same interruptire of the helical collars 16*b*, and rims 20 formed therein. The roller 14*b* has the helical collars 16*b* interrupted by rings 16*c* which, interdigitably, enter the reliefs 22*a* non-contactingly. The helical collars 16*b* also are spaced apart with further rims 20 interposed therebetween. FIG. 12 is a fragmentary cross-section taken through roller 14*b*, and FIG. 13 is a correspondingly fragmentary cross-section taken through roller 12*b*. In FIG. 14 the two fragmentary portions are shown in total mesh or interdigitation. The interengagement of the helical collars 16*b* cause the paper to be subdivided, diagonally, and the rings 16*c*, closing into the reliefs 22*a*, separate the paper lengthwise thereof. As a consequence, the paper is rather thoroughly dismembered.

The instant invention comprehends further embodiments which are especially designed to prevent the earlier mentioned excursive movement of the trailing portion of any throughput paper. One such embodiment 10*c* is shown in FIGS. 15 and 16. Here the rollers 12*c* and 14*c* have collars 16*d*, which are fully circular rings, with annular reliefs or gaps 22*b* alternating therebetween. To insure that the throughput paper 24 is surely held between the rollers 12*c* and 14*c*, elastomeric bands 30 are set about the gaps or reliefs 22*b*. Consequently, the paper is securely gripped all the while it passes through the interdigitated rollers 12*c* and 14*c*, even through to the very end of the sheet.

A final embodiment 10*d* of the invention incorporates a multifingered, paper guide 32 arranged at the entry side of the rollers 12*d* and 14*d*. The rollers have fully circular rings or collars 16*e* which have annular grooves 18*a* formed in the peripheries thereof. The guide 32 comprises a pair of converging limbs 34 which inboard thereof are formed into comb-like, cantilevered fingers 36. The fingers 36 are radially aligned with the grooves 18*a*, and cooperate with the collars or rings 16*e* to clasp the throughput paper 24 therebetween, and restrain it against excursive movement axially or otherwise.

While I have described my invention in connection with specific embodiments thereof, it is to be clearly understood that this is done only by way of example, and not as a limitation to the scope of the invention as set forth in the objects thereof and in the appended claims. For example, the rollers, rollers 12 and 14, typically, are shown to have a common diameter "D", in FIG. 1. The invention comprehends paired rollers, i.e., 12 and 14, 12*a* and 14*a*, etc., of differing diameters. Further, whereas the embodiment 10, of FIGS. 1 through 5, depicts the rollers 12 and 14 being driven by common diameter gears, and rotating at a common speed. Differing embodiments of the invention can be configured in which gears of diverse diameters, namely Gears "G" and "G'", as illustrated in FIG. 1 in phantom, can be employed to effect a greater r.p.m. of roller 12 as compared to the r.p.m. of roller 14. All such modifications of the invention as will occur to others from my disclosure are deemed to be within the ambit of my invention, and embraced by the appended claims.

I claim:

1. A paper-tearing rollers assembly, comprising:

a pair of elongate rollers, rotatable in opposite directions on parallel, central axes; and raised collars formed on each of said rollers; wherein said collars of each of said rollers comprise a plurality of spaced-apart, fully circular rings;

each of said rings has a given, overall width;

each said ring is spaced, across a gap, from another most adjacent ring, a distance which is greater than said overall width;

said rings of one of said rollers are non-contactingly intermeshed with said rings of the other of said rollers;

a plurality of spaced-apart rims formed on each of said rollers;

annular grooves formed in each of said rings;

each said rim intrudes into one of said grooves; and said rims have blunt, outermost peripheries.

2. A paper-tearing rollers assembly, according to claim 1, wherein:

each said rim, on one of said rollers, intrudes into a groove on the other of said rollers; and each said rim, on the other of said rollers, intrudes into a groove on said one roller.

3. A paper-tearing rollers assentbly, according to claim 1, wherein:

said rims are of tapered configuration.

4. A paper-tearing rollers assembly, according to claim 1, wherein:

said rings have knurled, peripheral surfaces.

5. A paper-tearing rollers assembly, comprising:

a pair of elongate rollers, rotatable in opposite directions on parallel, central axes; wherein said rollers have means mutually cooperative for tearing sheet paper into strips, said tearing means comprises raised collars formed on each of said rollers; and means carried by said rollers for forming said paper strips into V-shaped, channel configurations, said strip forming means comprising a groove formed in each said collar and a rim formed on each of said rollers, said rims having a tapered configuration having a blunt, outermost periphery such that each rim intrudes into a groove.

6. A paper-tearing rollers assembly, according to claim 5, wherein:

said collars of one of said rollers are non-contactingly intermeshed with said collars of the other of said rollers.

* * * * *